US005275570A

United States Patent [19]

Hicks

[11] Patent Number: 5,275,570

[45] Date of Patent: Jan. 4, 1994

[54] GOLF INSTRUCTIONAL AID DEVICE

[76] Inventor: Bradford L. Hicks, 1310 Baylor Blvd., Big Spring, Tex. 79720

[21] Appl. No.: 21,584

[22] Filed: Feb. 24, 1993

[51] Int. Cl.[5] ..... A63B 69/36

[52] U.S. Cl. ..... 434/252; 273/188 A; 273/33

[58] Field of Search ..... 434/252; 273/188

[56] References Cited

U.S. PATENT DOCUMENTS

| | | | |
|---|---|---|---|
| 1,922,130 | 8/1933 | Haserodt | 434/252 X |
| 3,014,075 | 6/1962 | Taylor | 273/188 A |
| 3,141,675 | 7/1964 | Street | 434/252 X |
| 3,166,327 | 1/1965 | Champion | 434/252 X |
| 3,229,981 | 1/1966 | Taber | 434/252 X |
| 3,868,116 | 2/1975 | Ford et al. | 273/192 X |
| 4,101,130 | 7/1978 | Richards | 434/252 X |
| 4,322,084 | 3/1982 | Reece et al. | 273/192 X |
| 4,925,192 | 5/1990 | Forbes | 273/188 A X |
| 5,083,789 | 1/1992 | Hickson | 273/188 A X |
| 5,180,168 | 1/1993 | Balestrieri | 273/192 X |

*Primary Examiner*—Gene Mancene
*Assistant Examiner*—L. Thomas
*Attorney, Agent, or Firm*—Michael I. Kroll

[57] ABSTRACT

A golf instructional aid device is provided which consists of a generally U-shaped flat frame having a V-shaped base with two parallel arms forming an open gate. The frame is secured to the turf, so that a golf ball can be placed upon the turf within the open gate between the arms. A structure on either of the arms is for allowing a golfer with a golf club to make a perfectly aligned stance, being a ball position and a hand position at address. The golfer can practice a golf swing at the golf ball, which will carry over to the play on the golf course when stroking the golf ball towards a hole.

12 Claims, 2 Drawing Sheets

GOLF INSTRUCTIONAL AID DEVICE

BACKGROUND OF THE INVENTION

1. Field of the Invention

The instant invention relates generally to golf equipment and more specifically it relates to a golf instructional aid device.

2. Description of the Prior Art

Numerous golf equipment have been provided in prior art that are adapted to assist golfers in gripping clubs, gauging/measuring distances and conditions, which might effect their play and in making strokes with the golf clubs. While these units may be suitable for the particular purpose to which they address, they would not be as suitable for the purposes of the present invention as heretofore described.

SUMMARY OF THE INVENTION

A primary object of the present invention is to provide a golf instructional aid device that will overcome the shortcomings of the prior art devices.

Another object is to provide a golf instructional aid device that allows a golfer to practice the golf swing with a perfectly aligned stance being a ball position and a hand position at address, which will carry over to the play on the golf course.

An additional object is to provide a golf instructional aid device that will eliminate bad swing habits resulting from a poor alignment and will give to the golfer an accurate reading of a golf club divot, which could indicate problems with the swing plane.

A further object is to provide a golf instructional aid device that is simple and easy to use.

A still further object is to provide a golf instructional aid device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
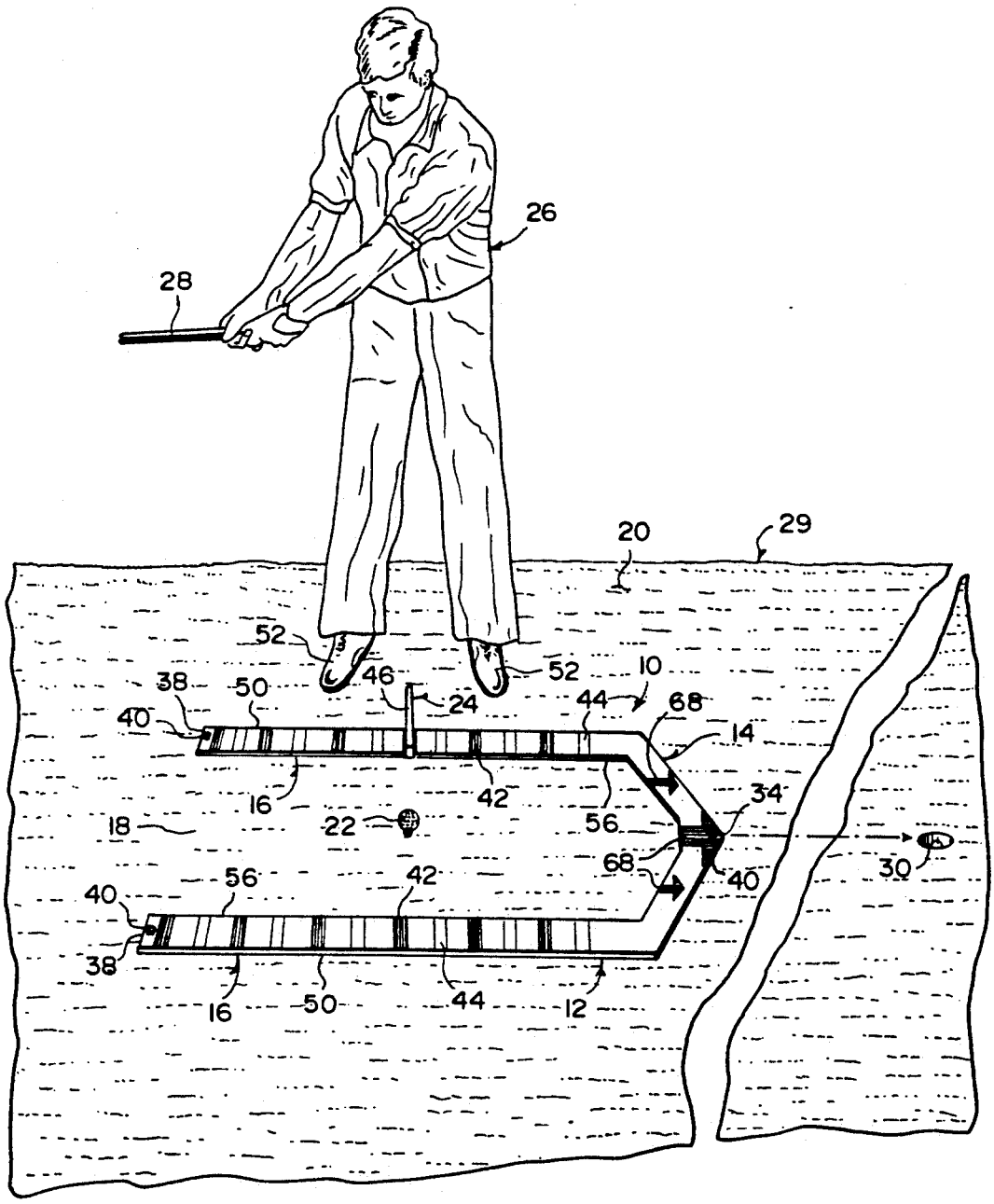
FIG. 1 is a perspective view of the instant invention in use.
Figure 2:
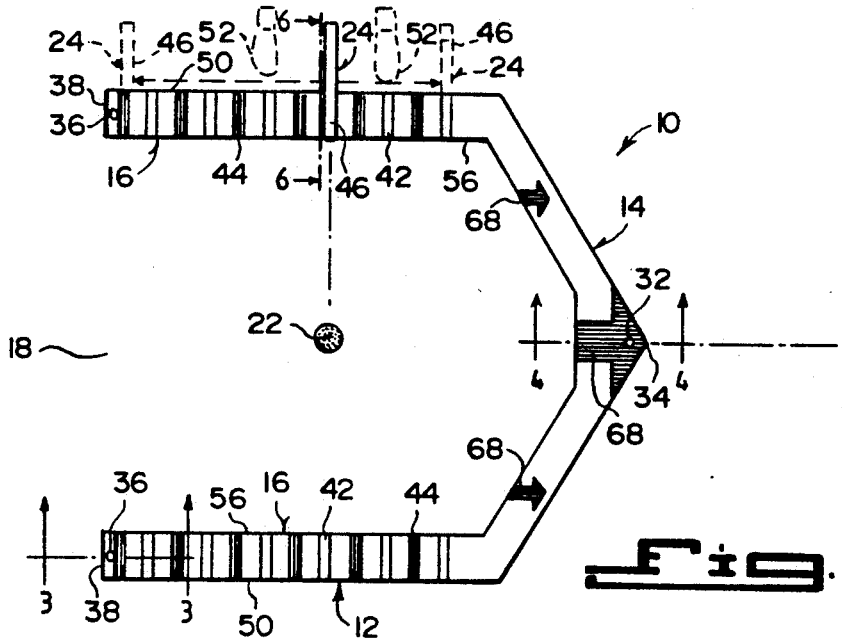
FIG. 2 is a top plan view of the instant invention per se.

Turning now descriptively to the drawings, in which similar reference characters denote similar elements throughout the several views, FIGS. 1 and 2 illustrate a golf instructional aid device 10, which consists of a generally U-shaped flat frame 12 having a V-shaped base 14 with two parallel arms 16, forming an open gate 18. The frame 12 is secured to the turf 20, so that a golf ball 22 can be placed upon the turf 20 within the open gate 18 between the arms 16. A structure 24, on either of the arms 16, is for allowing a golfer 26 with a golf club 28 to make a perfectly aligned stance, being a ball position and a hand position at address, so that the golfer 26 can practice a golf swing at the golf ball 22, which will carry over to the play on the golf course 29, when stroking the golf ball 22 towards a hole 30.

Figure 3:
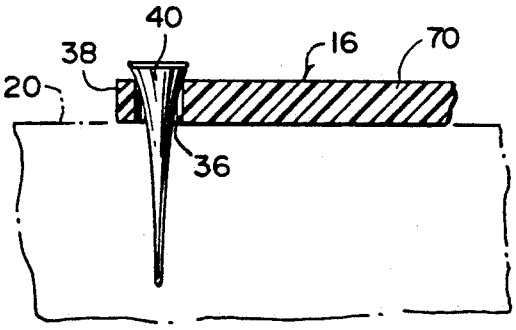
FIG. 3 is a cross sectional view taken along line 3—3 in FIG. 2.
Figure 4:
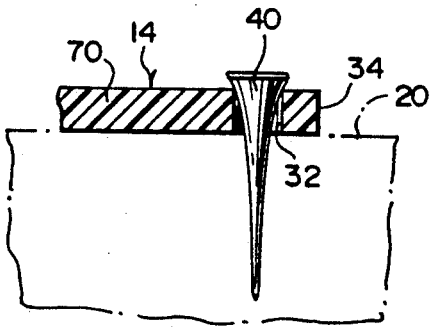
FIG. 4 is a cross sectional view taken along line 4—4 in FIG. 2.

As best seen in FIGS. 3 and 4, the V-shaped base 14 has an aperture 32 in a forward central portion 34. Each arm 16 has an aperture 36 in a rearward distal end 38. Three tees 40 are provided with each extending through the aperture 32 in the V-shaped base 14 and the aperture 36 in the arms 16 and then into the turf 20.

The stance allowing structure 24 includes a plurality of ball position indicator lines 42 across each arm 16 of the frame 12. A plurality of hand position indicator lines 44 are across each arm 16 of the frame 12, alternating between the ball position indicator lines 42. A ball position indicator attachment 46 is provided. An apparatus 48 is for holding the ball position indicator attachment 46 in an adjustable relationship onto one of the ball position indicator lines 42. The ball position indicator attachment 46 extends over an outer side edge 50 of the respective arm 16, and is in alignment with the golf ball 22. The feet 52 of the golfer 26 can be placed on either side of the ball position indicator attachment 46, allowing the golfer 26 to visually see the adjacent hand position indicator lines 44 on either side of the ball position indicator attachment 46, so as to make the perfectly aligned stance thereto.

Figure 5:
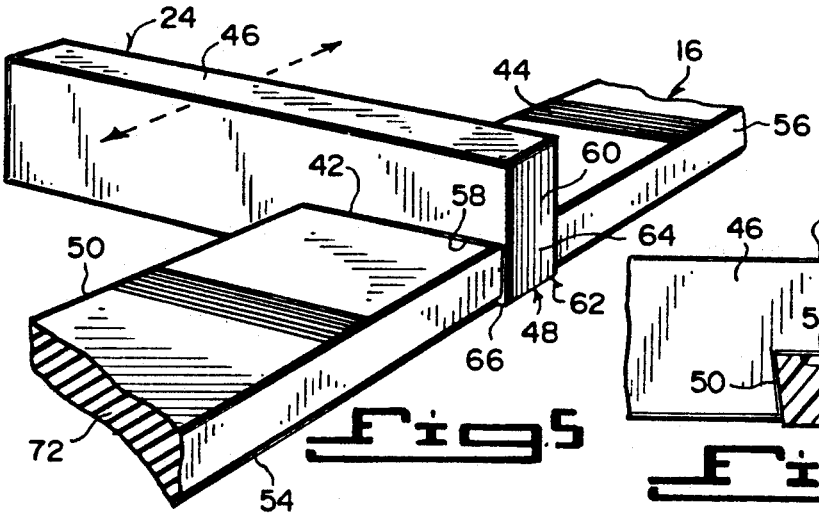
FIG. 5 is an enlarged perspective view of a portion thereof, showing the ball position indicator attachment in greater detail.
Figure 6:
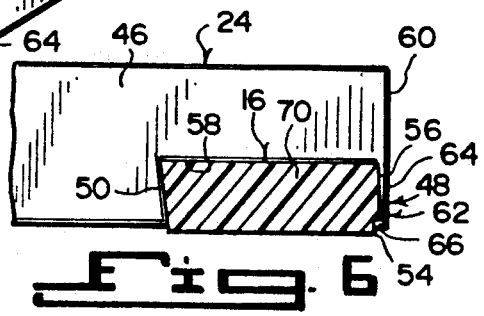
FIG. 6 is a cross sectional view taken along line 6—6 in FIG. 2.

The adjustable holding apparatus 48, best seen in FIGS. 5 and 6, consists of each arm 16 of the frame 12, having a linear track 54 along a lower corner of an inner side edge 56. The ball position indicator attachment 46 has a lower cutout area 58 at a back end 60 thereof, so as to fit over the width of each arm 16 of the frame 12. A spring finger 62 is formed on the back end 60 of the ball position indicator attachment 46. The spring finger 62 has a first portion 64 extending downwardly behind the cutout area and terminating in a second portion 66, bent laterally inwardly toward the linear track 54 in one arm 16 of the frame 12.

A plurality of target directional arrows 68 are on the V-shaped base 14 of the frame 12. The arrow 68 indicates to the golfer 26 the direction to stroke the golf ball 22 towards the hole 30.

The frame 12 is fabricated out of a durable strong material. The ball position indicator attachment 46 is also fabricated out of a durable strong material. In one instance, the frame 12 and the ball position indicator attachment 46 can be both fabricated out of an identical durable strong material. In another instance, the frame 12 and ball position indicator attachment 46 can be both fabricated out of different durable strong materials.

The durable strong material can be plastic 70, as shown in FIGS. 3, 4 and 6. The durable strong material can be rubber 72, as shown in FIG. 5.

To use the golf instructional aid device 10, the following steps should be taken:

1. Place the frame 12 on the turf 20 with the target directional arrows 68 on the V-shaped base 14 facing the hole 30 in the golf course 29.

2. Press the tees 40 through the apertures 32 and 36 and into the turf 20.

3. Slide the ball position indicator attachment 46 on either arm 16, to one of the ball position indicator lines 42, depending whether the golfer 26 is right handed or left handed.

4. Place the golf ball 22 through the open gate 18 between the arms 16, so that the golf ball 22 is in alignment with the ball position indicator attachment 46.

5. Put each foot 52 on either side of the ball position indicator attachment 46, so that the golfer 26 can take the proper stance.

6. Swing the golf club 28 to stroke the golf ball 22 towards the hole 30 in the golf course 29.

7. Remove the tees 40, so that the device 10 can be removed from the turf 20 and stored when the device 10 is no longer needed.

LIST OF REFERENCE NUMBERS

10 — golf instructional aid device
12 — frame
14 — V-shaped base of 12
16 — arm of 12
18 — open gate
20 — turf
22 — golf ball
24 — stance allowing structure
26 — golfer
28 — golf club
29 — golf course
30 — hole in 29
32 — aperture in 14
34 — forward central portion of 14
36 — aperture in 16
38 — rearward distal end of 16
40 — tee
42 — ball position indicator line on 16
44 — hand position indicator line on 16
46 — ball position indicator attachment
48 — adjustable holding apparatus in 46
50 — outer side edge of 16
52 — feet of 26
54 — linear track
56 — inner side edge of 16
58 — lower cutout area in 46
60 — back end of 46
62 — spring finger on 60
64 — first portion of 62
66 — second portion of 62
68 — target directional arrow on 14
70 — plastic
72 — rubber It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and described to be projected by Letters Patent is set forth in the appended claims:

1. A golf instructional aide device which comprises:
a) a generally U-shaped flat frame having a V-shaped base with two parallel arms forming an open gate;
b) securing means for securing said frame to the turf so that a golf ball can be placed upon the turf within the open gate between said arms; and
c) stance allowing means on either of said arms, for allowing a golfer with a golf club to make a perfectly aligned stance, being a bail position and a hand position at address, so that the golfer can practice a golf swing at the golf ball, which will carry over to the play on a golf course when stroking the golf ball towards a hole;

wherein said stance allowing means includes:
a) a plurality of ball position indicator lines across each said arm of said frame;
b) a plurality of hand position indicator lines across each said arm of said frame, alternating between said ball position indicator lines;
c) a ball position indicator attachment; and
d) means for holding said ball position indicator attachment in an adjustable relationship onto one of said ball position indicator lines, with said ball position indicator attachment extending over an outer side edge of said respective arm and in alignment with the golf ball, so that the feet of the golfer can be placed on either side of said ball position indicator attachment, allowing the golfer to visually see said adjacent hand position indicator lines on either side of said ball position indicator attachment, so as to make the perfectly aligned stance thereto.

2. A golf instructional aid device as recited in claim 1, wherein said securing means includes:
a) said V-shaped base having an aperture in a forward central portion;
b) each said arm having an aperture in a rearward distal end; and
c) three tees, each to extend through said aperture in said V-shaped base and said apertures in said arms and then into the turf.

3. A golf instructional aid device as recited in claim 1, wherein said adjustable holding means includes:
a) each said arm of said frame having a linear track along a lower corner of an inner side edge;
b) said ball position indicator attachment having a lower cutout area at a back end thereof, so as to fit over the width of each said arm of said frame; and
c) a spring finger formed on said back end of said ball position indicator attachment, said spring finger having a first portion extending downwardly behind said cutout area and terminating in a second portion bent laterally inwardly toward said linear track in one said arm of said frame.

4. A golf instructional aid device as recited in claim 3, further including a plurality of target directional arrows on said V-shaped base of said frame, so as to indicate to the golfer the direction to stroke the golf ball towards the hole.

5. A golf instruction aid device as recited in claim 4, wherein said frame is fabricated out of a durable strong material.

6. A golf instructional aid device as recited in claim 5, wherein said ball position indicator attachment is fabricated out of a durable strong material.

7. A golf instructional aid device as recited in claim 6, wherein said frame attachment can be both fabricated out of an identical durable strong material.

8. A golf instructional aid device as recited in claim 6, wherein said frame and said ball position indicator attachment can be both fabricated out of different durable strong materials.

9. A golf instructional aid device as recited in claim 5, wherein said durable strong material is plastic.

10. A golf instructional aid device as recited in claim 5, wherein said durable strong material is rubber.

11. A golf instructional aid device as recited in claim 6, wherein said durable strong material is plastic.

12. A golf instructional aid device as recited in claim 6, wherein said durable strong material is rubber.

* * * * *